US010960247B2

(12) United States Patent
Arcaraz

(10) Patent No.: US 10,960,247 B2
(45) Date of Patent: Mar. 30, 2021

(54) FIRE EXTINGUISHING TOOL

(71) Applicant: Antonino Arcaraz, Le Grand, CA (US)

(72) Inventor: Antonino Arcaraz, Le Grand, CA (US)

( * ) Notice: Subject to any disclaimer, the term of this patent is extended or adjusted under 35 U.S.C. 154(b) by 40 days.

(21) Appl. No.: 16/414,911

(22) Filed: May 17, 2019

(65) Prior Publication Data

US 2020/0360747 A1 Nov. 19, 2020

(51) Int. Cl.
*A62C 8/04* (2006.01)

(52) U.S. Cl.
CPC ..... *A62C 8/04* (2013.01)

(58) Field of Classification Search
CPC ..... A62C 8/04
USPC ..... 239/48–50
See application file for complete search history.

(56) References Cited

U.S. PATENT DOCUMENTS

| | | | | |
|---|---|---|---|---|
| 524,754 | A | 7/1895 | Dawson | |
| 1,236,583 | A | 8/1917 | Shving | |
| 1,951,798 | A | 3/1934 | Lawson | |
| 2,305,950 | A * | 12/1942 | Birch | A62C 3/06 86/50 |
| 2,340,370 | A | 2/1944 | Doyle | |
| 2,354,762 | A | 8/1944 | Mcferron | |
| 2,720,269 | A | 10/1955 | Diacos | |
| 3,782,475 | A | 1/1974 | Schmidt | |
| 4,602,611 | A | 7/1986 | Hankey | |
| 8,443,910 | B2 | 5/2013 | Parsley | |
| 2003/0155134 | A1 | 8/2003 | Chattaway | |

* cited by examiner

*Primary Examiner* — Christopher S Kim

(57) ABSTRACT

A fire extinguishing tool for extinguishing a fire on ground without a chemical fire extinguisher includes a handle that has a head being oriented at an angle with a shaft. Thus, the head can be oriented parallel with ground when the shaft is gripped. A panel is coupled to the head and the panel lies on a plane oriented parallel to ground when the shaft is gripped. Additionally, the panel is positionable on the ground to stamp out a fire burning on the ground.

9 Claims, 4 Drawing Sheets

FIRE EXTINGUISHING TOOL

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to extinguishing devices and more particularly pertains to a new extinguishing device for extinguishing a fire on the ground without a chemical fire extinguisher.

BRIEF SUMMARY OF THE INVENTION

An embodiment of the disclosure meets the needs presented above by generally comprising a handle that has a head being oriented at an angle with a shaft. Thus, the head can be oriented parallel with ground when the shaft is gripped. A panel is coupled to the head and the panel lies on a plane oriented parallel to ground when the shaft is gripped. Additionally, the panel is positionable on the ground to stamp out a fire burning on the ground.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
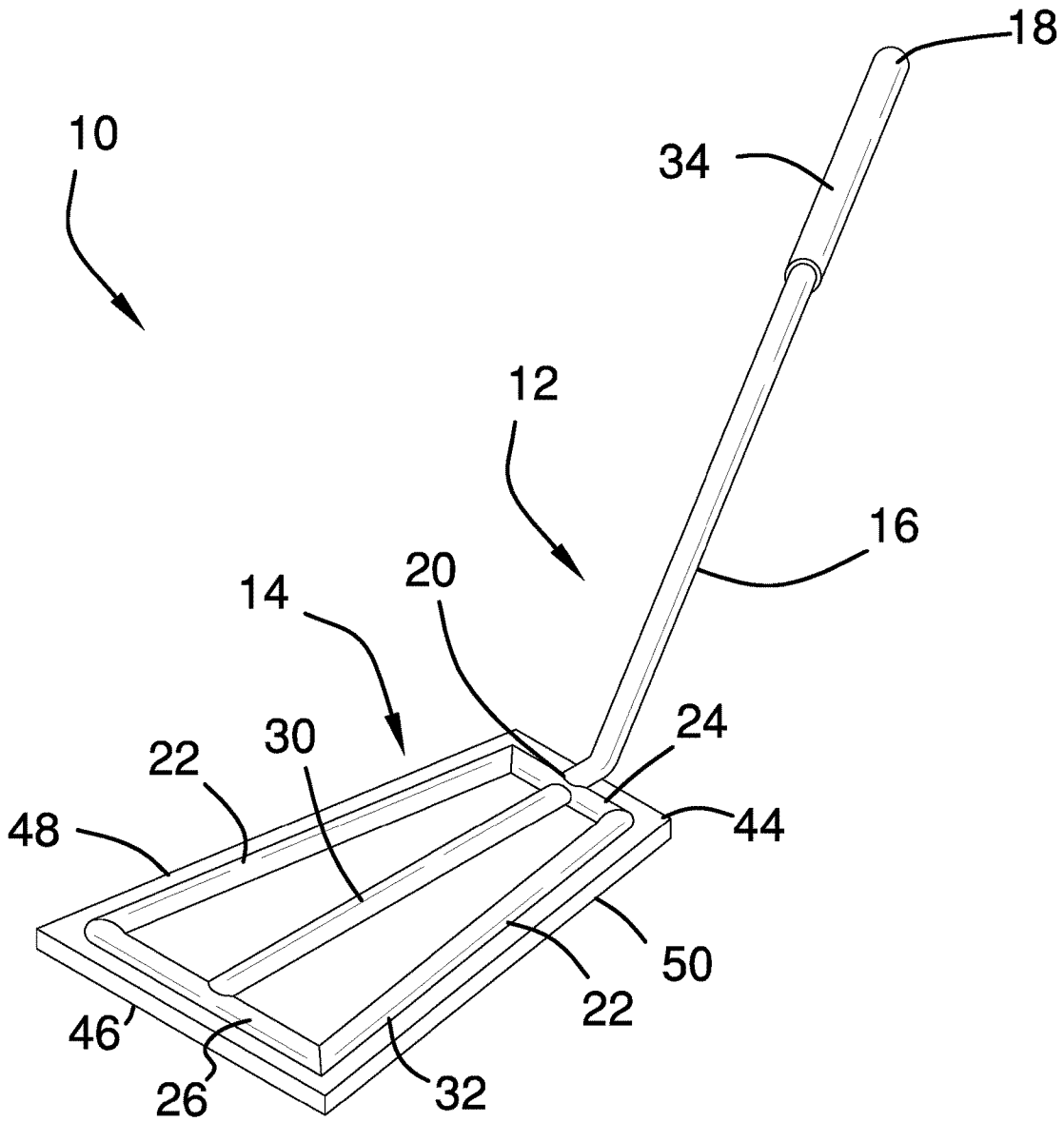
FIG. 1 is a top perspective view of a fire extinguishing tool according to an embodiment of the disclosure.
Figure 2:
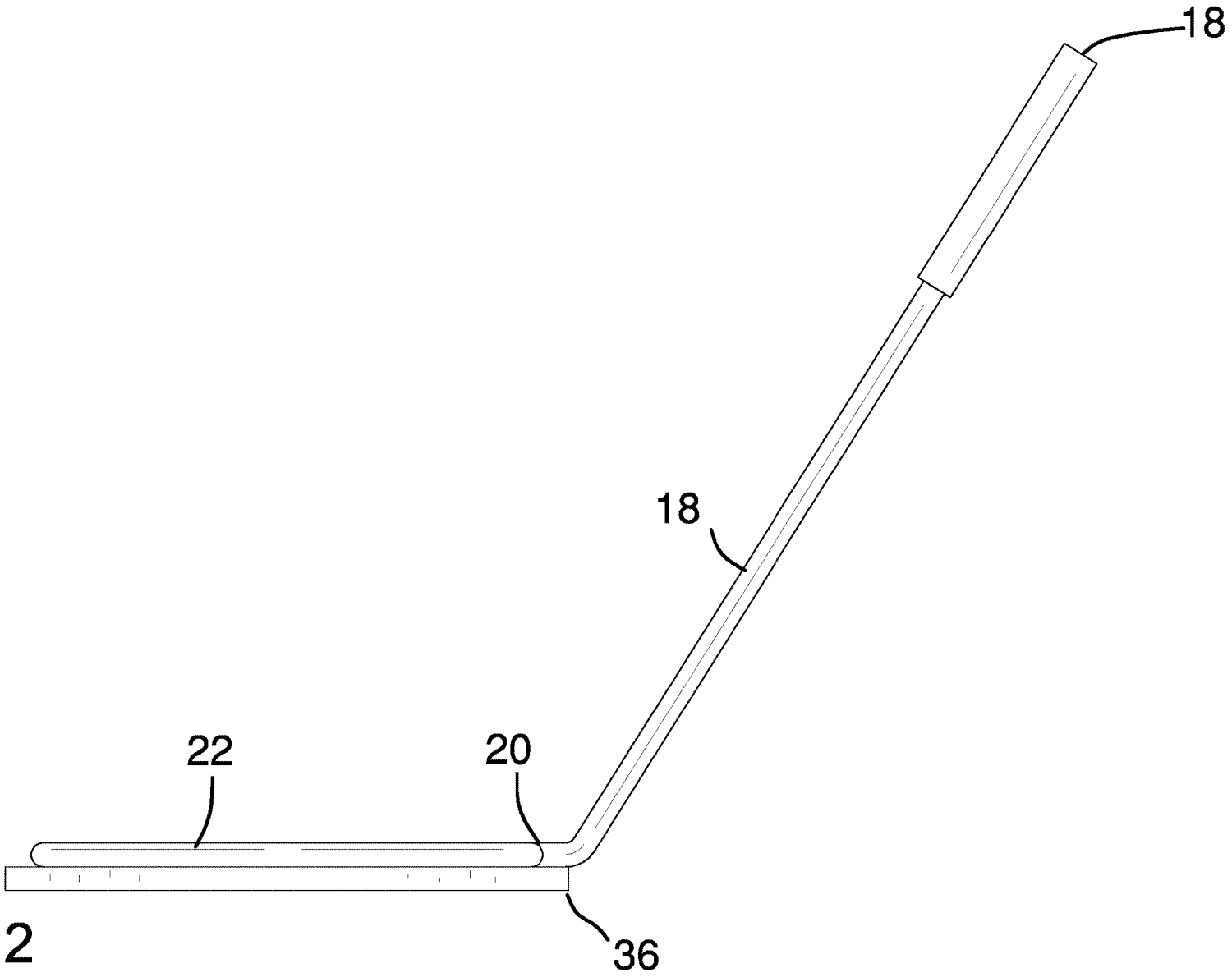
FIG. 2 is a left side view of an embodiment of the disclosure.
Figure 4:
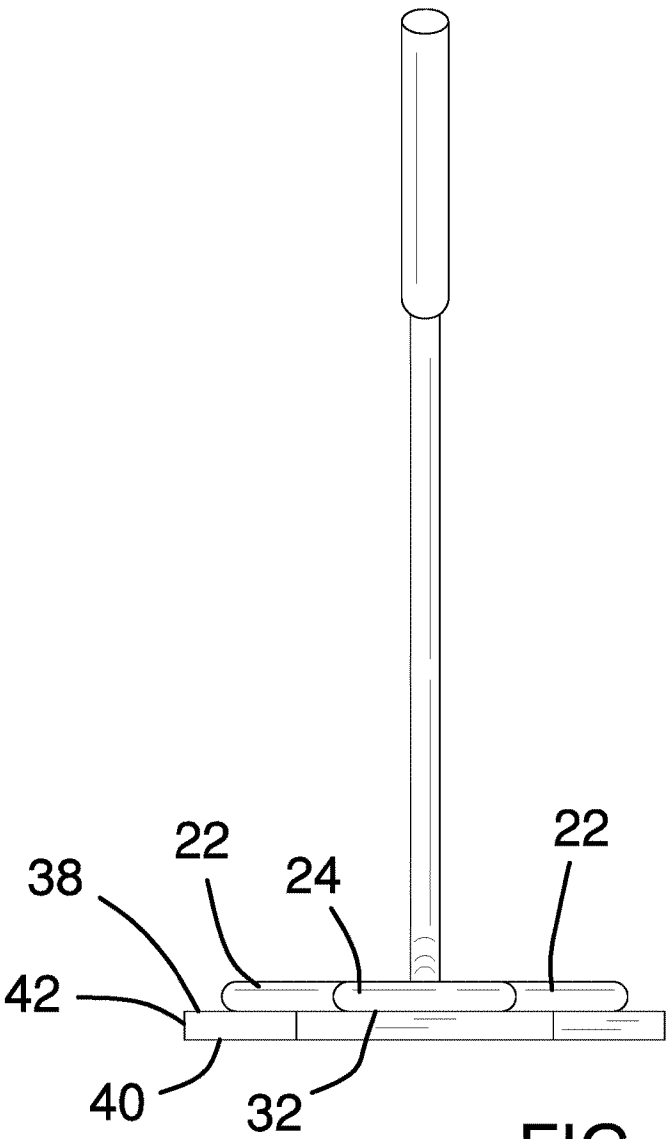
FIG. 4 is a back view of an embodiment of the disclosure.
Figure 3:
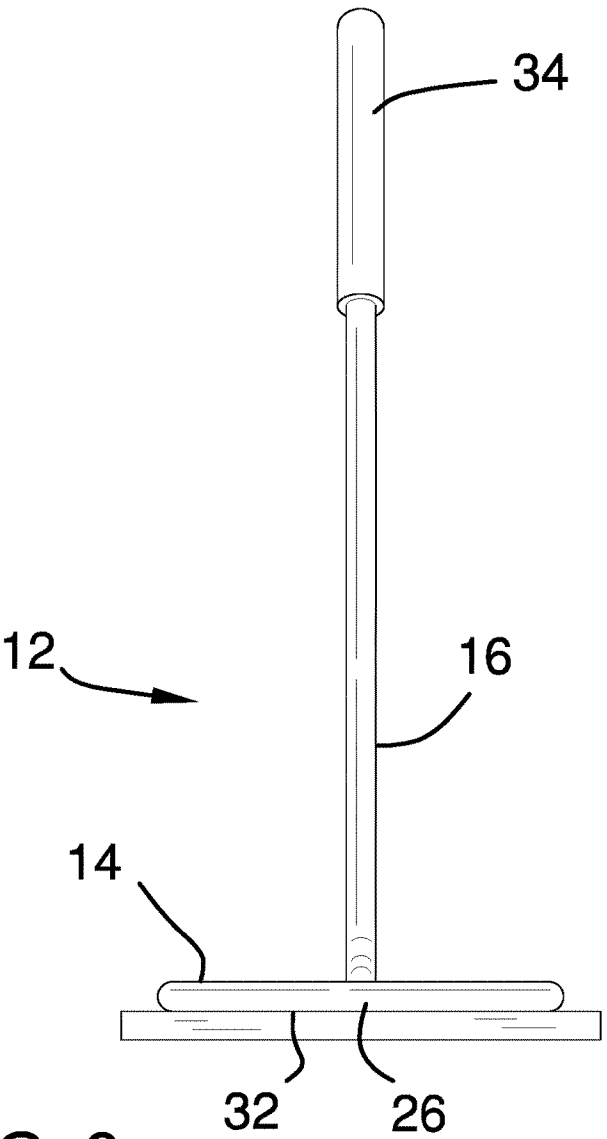
FIG. 3 is a front view of an embodiment of the disclosure.
Figure 5:
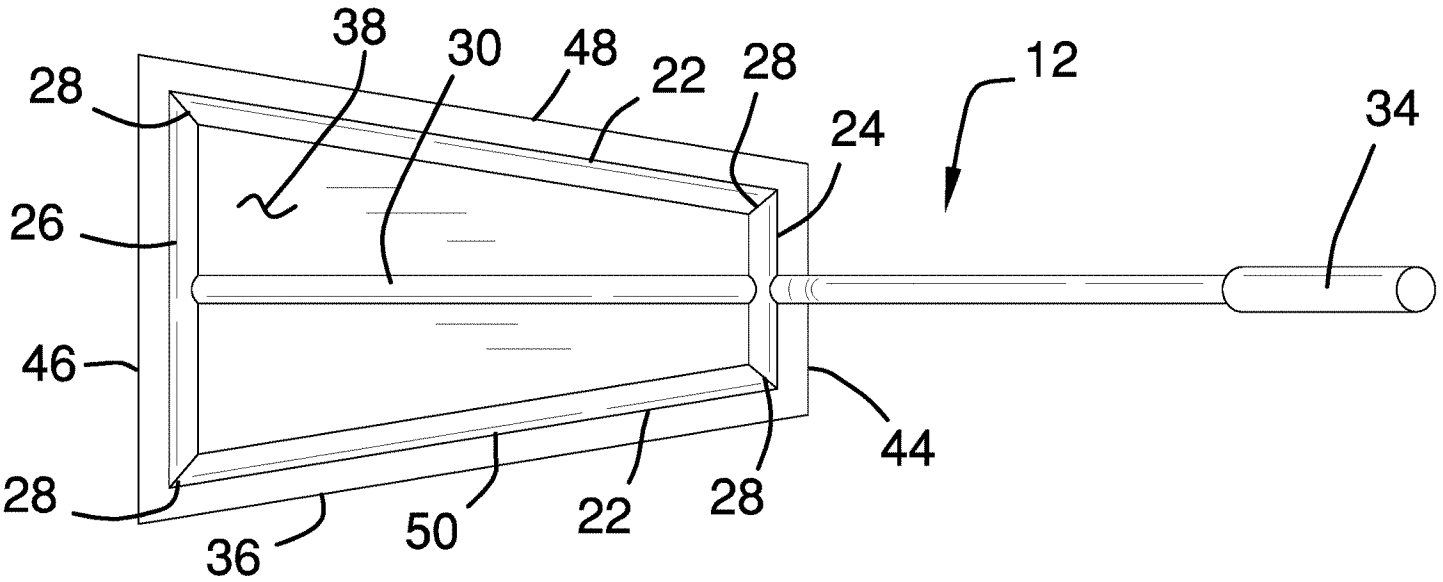
FIG. 5 is a top view of an embodiment of the disclosure.
Figure 6:
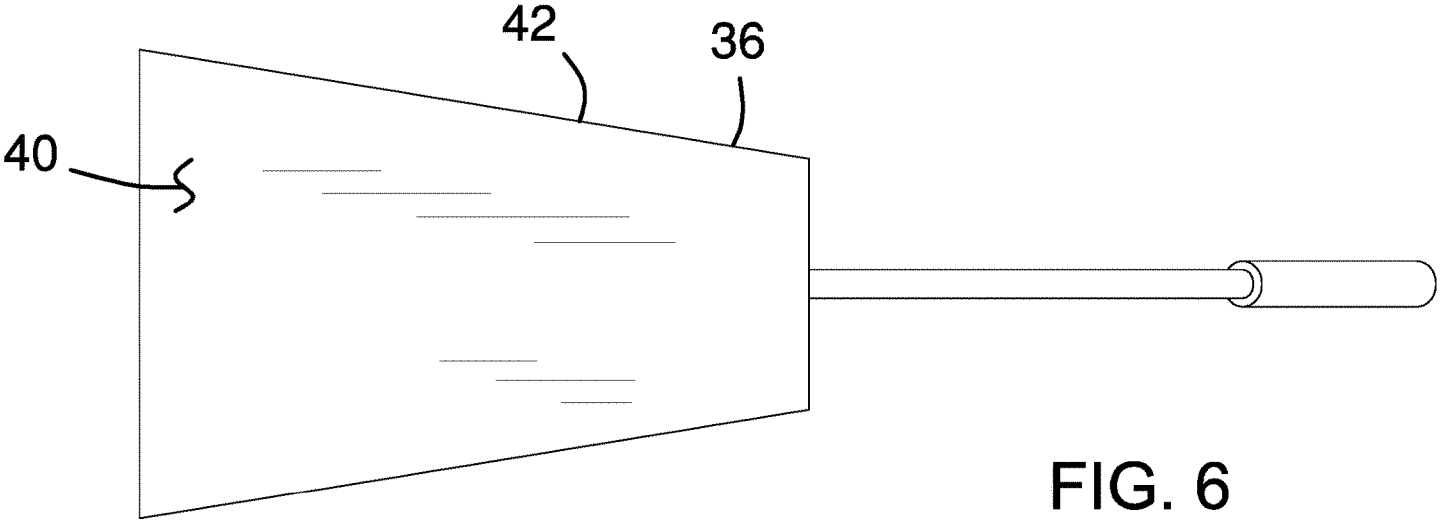
FIG. 6 is a bottom view of an embodiment of the disclosure.

With reference now to the drawings, and in particular to FIGS. 1 through 6 thereof, a new extinguishing device embodying the principles and concepts of an embodiment of the disclosure and generally designated by the reference numeral 10 will be described.

As best illustrated in FIGS. 1 through 6, the fire extinguishing tool 10 generally comprises a handle 12 that has a head 14 being oriented at an angle with a shaft 16. In this way the head 14 can be oriented parallel with ground when the shaft 16 is gripped. The shaft 16 has a first end 18 and a second end 20, and the shaft 16 may have a length of at least 36.0 inches. In this way the head 14 can be positioned on or near the ground without requiring a user to bend over.

The head 14 comprises a pair of first members 22 that is each coupled to and extends between a second member 24 and a third member 26. The second member 24 has a length that is less than a length of the third member 26. Additionally, each of the first members 22 is aligned with a respective end 28 of each of the second 24 and third 26 members such that the head 14 forms a trapezoidal shape. The second member 24 has the second end 20 of the shaft 16 being coupled thereto and the shaft 16 is centrally positioned on the second member 24.

The shaft 16 is oriented to extend along an axis that is oriented perpendicular to a longitudinal axis of the second member 24. Moreover, the axis of shaft 16 is oriented to form an obtuse angle with a longitudinal axis each of the first members 22. Thus, the shaft 16 angles upwardly and rearwardly from the head 14. Each of the first members 22 may have a length of at least 18.0 inches, the second member 24 may have a length of at least 6.0 inches and the third member 26 may have a length of at least 10.0 inches. The head 14 includes a central member 30 that is coupled between each of the second 24 and third 26 members. The central member 30 is centrally positioned between each of the first members 22. Additionally, each of first 22, second 24, third 26 and central 30 members have a bottom surface 32.

A grip 34 is coupled around the shaft 16 and the grip 34 extends from the first end 18 toward the second end 20. The grip 34 is comprised of a resiliently compressible material to enhance gripping the shaft 16. A panel 36 is coupled to the head 14 and the panel 36 lies on a plane oriented parallel to ground when the shaft 16 is gripped. The panel 36 is positionable on the ground to stamp out a fire burning on the ground. In this way a grass fire or the like can be extinguished without employing a chemical fire extinguisher. Moreover, the panel 36 is comprised of a heat resistant material such as steel or the like.

The panel 36 has a top surface 38, a bottom surface 40 and a perimeter edge 42 extending therebetween. The perimeter edge 42 has a back side 44, a front side 46, a first lateral side 48 and a second lateral side 50. The back side 44 has a length that is less than a length of the front side 46. Additionally, each of the first 48 and second 50 lateral sides angle outwardly between the back 44 and front 46 sides such that the panel 36 forms a trapezoid.

The top surface 38 of the panel 36 is bonded to the bottom surface 32 of each of the first 22, second 24, third 26 and central 30 members of the head 14. Thus, the bottom surface 40 of the panel 36 can abut the ground. Additionally, the first 22, second 24, third 26 and central 30 members enhance rigidity of the panel 36. The back side 44 is aligned with and is collinear with the second member 24 of the head 14. The front side 46 is aligned with and is collinear with the third member 26 of the head 14. Additionally, each of the first 48 and second 50 lateral sides is aligned with and is collinear with a respective one of the first members 22 of the head 14.

In use, the shaft 16 is gripped when a fire, such as an uncontrolled grass fire or the like, is burning on the ground. The panel 36 is repeatedly struck on the fire thereby facilitating the fire to be stamped out. In this way the fire can be extinguished without the use of a chemical fire extinguisher. The angle of the shaft 16 with respect to the head 14 facilitates the panel 36 to be placed on the ground without requiring a user to bend over.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

The invention claimed is:

1. A fire extinguishing tool being configured to stamp out fires on a ground surface, said assembly comprising:

a handle having a head being oriented at an angle with a shaft wherein said head is configured to be oriented parallel with the ground surface when said shaft is gripped; and a panel being coupled to said head wherein said panel is configured to lie on a plane being oriented parallel to the ground surface when said shaft is gripped, said panel being positionable on the ground surface wherein said panel is configured to stamp out a fire burning on the ground surface;

said shaft has a first end and a second end; and said head comprises a pair of first members each being coupled to and extending between a second member and a third member, said second member having a length being less than a length of said third member, each of said first members being aligned with a respective end of each of said second and third members such that said head forms a trapezoidal shape.

2. The assembly according to claim 1, wherein said second member has said second end of said shaft being coupled thereto, said shaft being centrally positioned on said second member.

3. The assembly according to claim 2, wherein said shaft is oriented to extend along an axis being oriented perpendicular to a longitudinal axis of said second member.

4. The assembly according to claim 3, wherein said axis of shaft is oriented to form an obtuse angle with a longitudinal axis each of said first members such that said shaft angles upwardly and rearwardly from said head.

5. The assembly according to claim 1, wherein said head comprises a central member being coupled between each of said second and third members, said central member being centrally positioned between each of said first members, each of first, second, third and central members having a bottom surface.

6. The assembly according to claim 5, wherein said panel has a top surface, a bottom surface and a perimeter edge extending therebetween, said perimeter edge having a back side, a front side, a first lateral side and a second lateral side, said back side having a length being less than a length of said front side, each of said first and second lateral sides angling outwardly between said back and front sides such that said panel forms a trapezoid, said top surface of said panel being bonded to said bottom surface of each of said first, second, third and central members of said head wherein said bottom surface of said panel is configured to abut the ground surface.

7. The assembly according to claim 6, wherein said back side is aligned with and is collinear with said second member of said head, said front side being aligned with and being collinear with said third member of said head, each of said first and second lateral sides being aligned with and being collinear with a respective one of said first members of said head.

8. The assembly according to claim 1, further comprising a grip being coupled around said shaft, said grip extending from said first end toward said second end, said grip being comprised of a resiliently compressible material wherein said grip is configured to enhance gripping said shaft.

9. A fire extinguishing tool being configured to stamp out fires on a ground surface, said assembly comprising:

a handle having a head being oriented at an angle with a shaft wherein said head is configured to be oriented parallel with the ground surface when said shaft is gripped, said shaft having a first end and a second end, said head comprising:

a pair of first members each being coupled to and extending between a second member and a third member, said second member having a length being less than a length of said third member, each of said first members being aligned with a respective end of each of said second and third members such that said head forms a trapezoidal shape, said second member having said second end of said shaft being coupled thereto, said shaft being centrally positioned on said second member, said shaft being oriented to extend along an axis being oriented perpendicular to a longitudinal axis of said second member, said axis of shaft being oriented to form an obtuse angle with a longitudinal axis each of said first members such that said shaft angles upwardly and rearwardly from said head; and a central member being coupled between each of said second and third members, said central member being centrally positioned between each of said first members, each of first, second, third and central members having a bottom surface;

a grip being coupled around said shaft, said grip extending from said first end toward said second end, said grip being comprised of a resiliently compressible material wherein said grip is configured to enhance gripping said shaft; and a panel being coupled to said head wherein said panel is configured to lie on a plane being oriented parallel to the ground surface when said shaft is gripped, said panel being positionable on the ground surface wherein said panel is configured to stamp out a fire burning on the ground surface, said panel having a top surface, a bottom surface and a perimeter edge extending therebetween, said perimeter edge having a back side, a front side, a first lateral side and a second lateral side, said back side having a length being less than a length of said front side, each of said first and second lateral sides angling outwardly between said back and front sides such that said panel forms a trapezoid, said top surface of said panel being bonded to said bottom surface of each of said first, second, third and central members of said head wherein said bottom surface of said panel is configured to abut the ground surface, said back side being aligned with and being collinear with said second member of said head, said front side being aligned with and being collinear with said third member of said head, each of said first and second lateral sides being aligned with and being collinear with a respective one of said first members of said head.

* * * * *